United States Patent [19]

Pittman et al.

[11] Patent Number: 4,848,412

[45] Date of Patent: Jul. 18, 1989

[54] PATTERNED WOVEN FABRIC

[75] Inventors: Edgar H. Pittman; Charles E. Warner, both of Spartanburg, S.C.

[73] Assignee: Milliken Research Corporation, Spartanburg, S.C.

[21] Appl. No.: 257,612

[22] Filed: Oct. 14, 1988

Related U.S. Application Data

[62] Division of Ser. No. 159,150, Feb. 23, 1988.

[51] Int. Cl.[4] ..... D03D 25/00

[52] U.S. Cl. ..... 439/383 R; 139/384 R; 139/416

[58] Field of Search ..... 139/383 R, 384 R, 304, 139/188 R, 190, 192, 416, 417

[56] References Cited

U.S. PATENT DOCUMENTS

| | | | |
|---|---|---|---|
| 1,077,128 | 10/1913 | Doughty | 139/384 R |
| 1,910,946 | 5/1933 | Bonniu | 139/192 |
| 3,696,845 | 10/1972 | Acker et al. | 139/383 R |
| 4,736,776 | 4/1988 | Vandeweghi et al. | 139/304 |

FOREIGN PATENT DOCUMENTS

| | | | |
|---|---|---|---|
| 1589 | 1/1972 | Japan | 139/416 |

*Primary Examiner*—Henry S. Jaudon

*Attorney, Agent, or Firm*—Earle R. Marden; H. William Petry

[57] ABSTRACT

A novel method and apparatus to produce a novel woven fabric with a pattern integral therewith. The pattern is formed in the fabric during weaving by selectively stretching the wrap yarn between the fell line and the warp beam so that the stretched warp yarn creates an open area and upon release creates an area of high density fill yarn.

1 Claim, 4 Drawing Sheets

PATTERNED WOVEN FABRIC

This is a division of application Ser. No. 159,150 filed Feb. 23, 1988 for Patterned Woven Fabric.

This invention relates generally to a woven fabric with a pattern or design therein and in particular to the method and apparatus to provide a pattern or design in a fabric while it is being woven on the loom.

In the past, pattern effects have been obtained in woven fabrics to enhance the aesthetics of the fabric. Numerous complicated mechanisms have been employed, either on the loom or off the loom, to obtain the desired pattern. It is therefore an object of the invention to provide a simple electro-mechanical device on a loom which acts on the fabric while it is being woven to provide the desired pattern effect.

Other objects and advantages of the invention will become readily apparent as the specification proceeds to describe the invention, with reference to the accompanying drawings, in which.

The patterns formed in a woven fabric by the herein disclosed invention are defined by a series of preselected designs transverse and/or longitudinal of the woven fabric. In its simplest form the design can be defined as an area of abnormally high pick count associated with an area of abnormally low pick count as compared to a normal woven fabric.

The designs are formed by periodically applying pressure on a woven fabric to stretch the warp yarns on the loom causing the newly inserted picks to bow away from the fell line which results in an area of low pick count upstream from the bowed picks as subsequent picks are inserted straight. Then the applied pressure is released to allow the stretched warp yarns to relax for a period of time which, if sufficient, will then bow recently inserted picks in a direction opposite to the bowing caused by the applied pressure. This subsequent bowing and the action of the reed against the subsequently inserted picks will cause these picks to be pushed together resulting in an area of abnormally high pick count. The location and size of the areas of low and high pick count in any given fabric is dependent on the number of spaced portions of the fabric acted on, the timing between the activation and deactivation of the applied pressure, the amplitude of the pressure exerting member and the rate of activation and deactivation.

Figure 1:
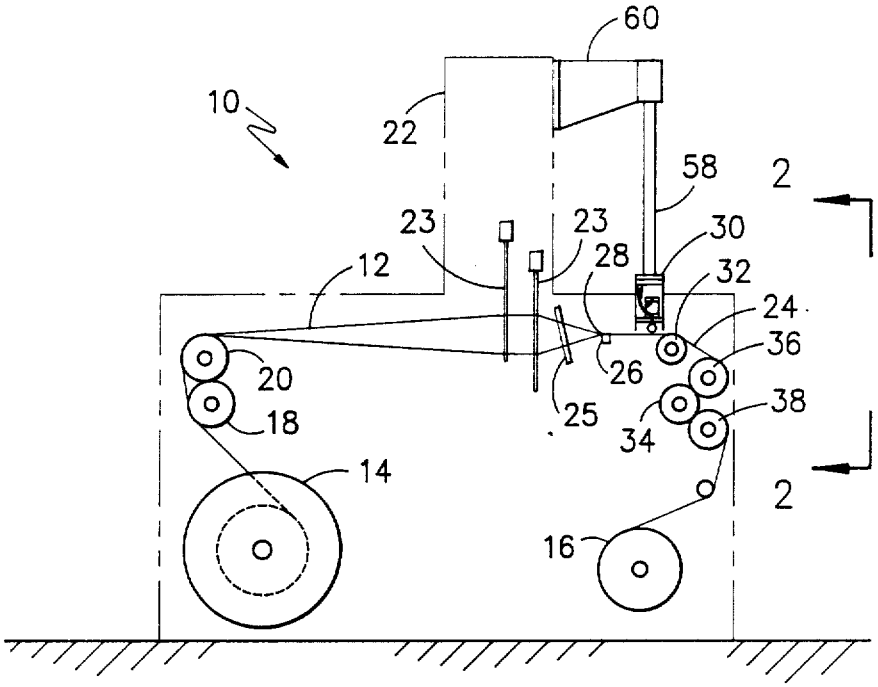
FIG. 1 is a schematic side elevation view of a conventional loom incorporating the novel patterning apparatus.

Looking now to the drawings, FIG. 1 illustrates a typical weaving machine (loom) 10, which in the preferred form of the invention is an air jet or water jet loom, on which warp yarn 12 is supplied from a warp beam 14 and taken up as woven fabric on the take-up roll 16. The warp yarn 12 is supplied from the warp beam 14 over the rolls 18 and 20 to the heddle section 22 whereat it is acted upon by the heddles 23 and reed 25 to be formed, in a conventional manner, into fabric 24 as it passes over the fell bar 26 located generally below and to the side of the fell line 28 of the fabric. From the fell bar 26 the fabric 24 passes under the pattern generator 30 and over the roll 32 to the sand roll 34 to be held thereagainst by the press rolls 36 and 38. From the sand roll 34 the fabric 24 is delivered to the take-up roll 16.

Figure 2:
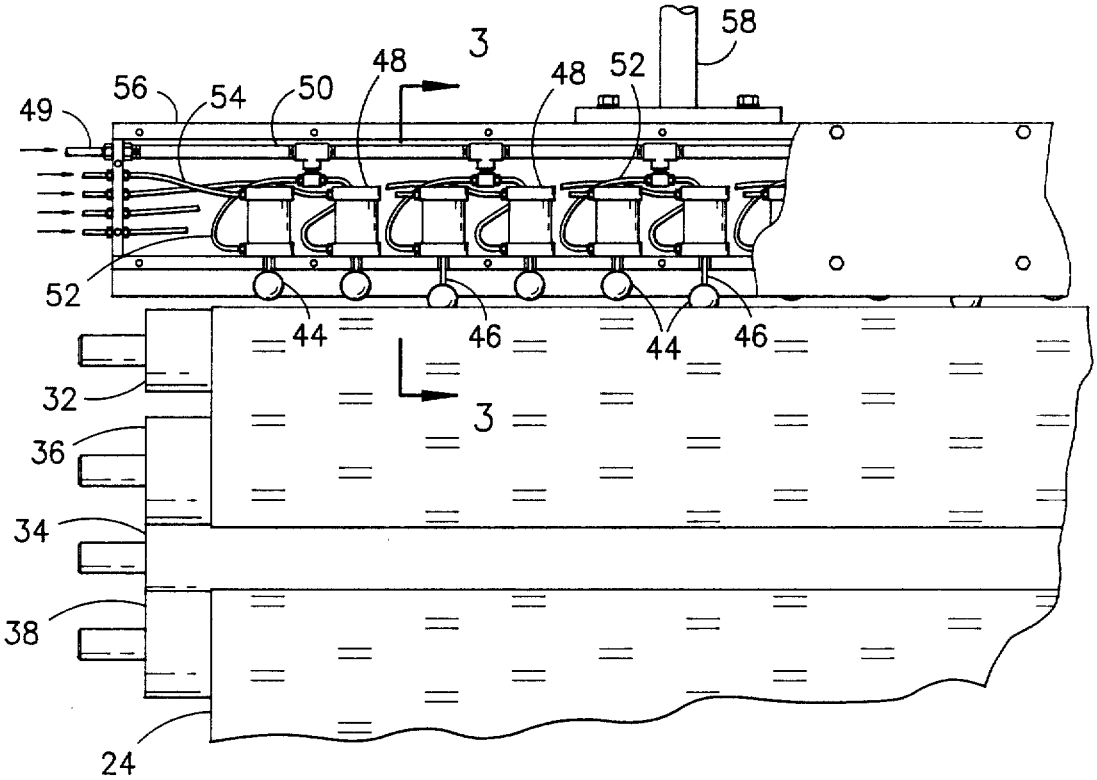
FIG. 2 is an elevation view taken on line 2—2 of FIG. 1 looking into the output side of the loom.
Figure 3:
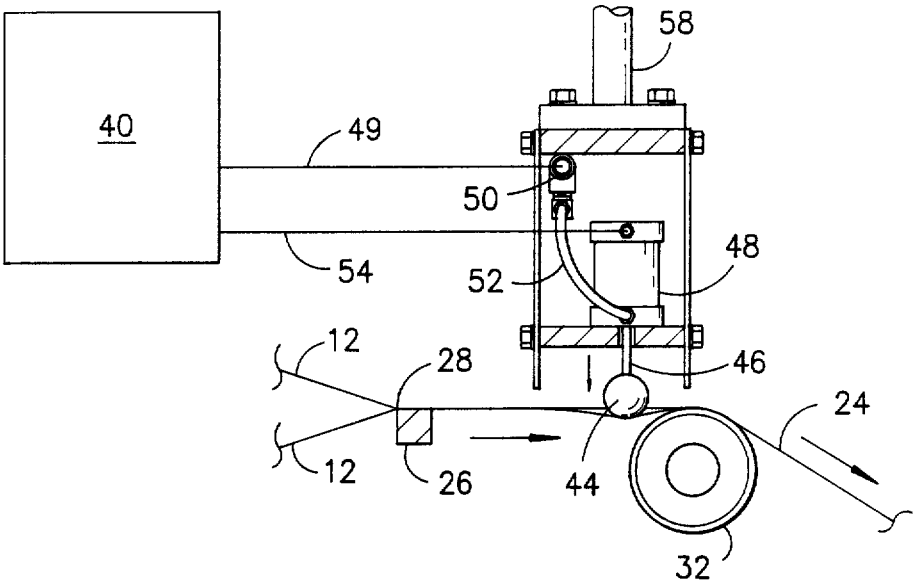
FIG. 3 is an enlarged view of the fabric patterning apparatus.

In the form of the invention shown in FIGS. 1–3, the feet 44 are in the form of balls which are connected to a piston rod 46 operably connected to an air cylinder 48 supplied with low pressure air at the bottom through low pressure air supply line 49, manifold 50 and conduits 52 to bias the piston rod 46 and foot 44 to the upward position. Also connected to each air cylinder 48 is a high pressure air line conduit 54 to supply high pressure air into the top of the piston to force the piston rod and foot 44 downward into operative position against the fabric 24 downstream of the fell bar 26. The gun bar frame 56 supporting the pattern generator 30 is secured by suitable rods 58 and support structure 60 to the frame of the loom.

In one form of the invention the loom 10 will be a water jet loom producing a 70 denier pongee plain woven fabric with 80 ends per inch and 80 picks per inch. A plurality of sets of eight feet 44 and air pistons 48 are mounted in the gun bar frame 56 across the loom above and between the fell bar 26 and the vacuum slot (not shown) near the press roll 36. The air cylinders 48 are mounted on 2"centers across the gun bar with the air tubes 54 connected to electrically actuated air valves (not shown) mounted in the controller 40. The air valves in the controller are three-way valves which either allow flow from a high pressure air source into the conduits 54 or exhaust air therefrom to allow the air from the low pressure air manifold to move the feet 44 to the upward position.

The controller 40 includes a programmable Barco 8 channel controller normally used to activate a pattern device for a loom dobby or filling selector device. The controller has the ability to open and close switches to 8 channels in a pre-programmed fashion using an "Eprom" memory insert which can be programmed off-line. Each channel is electrically connected to one of eight air valves to control the flow of high pressure air to and from the air cylinders.

Figure 4:
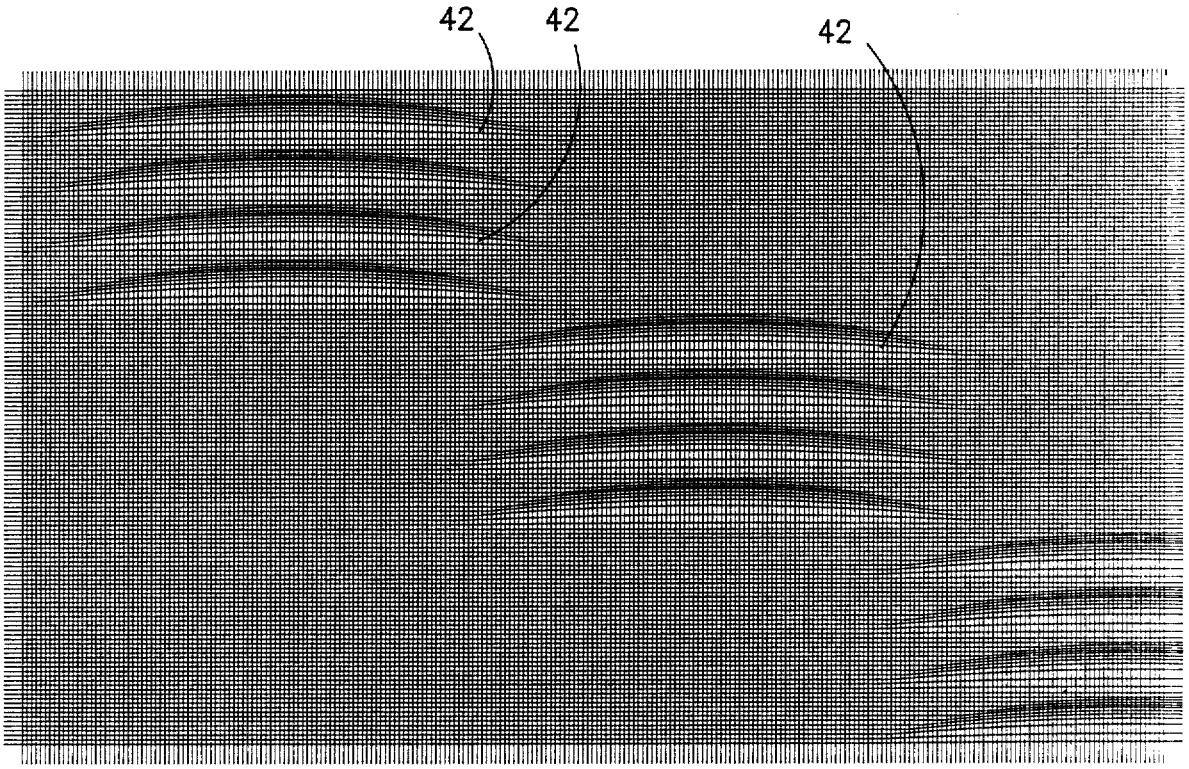
FIG. 4 is a representation fabric which can be woven on the apparatus of FIGS. 1–3, and FIGS. 5–7 each represent a modification of the fabric shown in FIG. 4.

FIG. 4 shows a typical fabric that can be woven with the loom of FIGS. 1–3. The pattern generator 30 is activated and deactivated by the controller 40 to provide the designs 42 in the fabric 24. As shown in FIG. 4 a plurality of designs 42 can be placed in one area with another group of designs staggered and offset therefrom. The particular arrangement of the designs 42 is controlled by the input to the pattern generator and the shape and spacing of the feet 44 of the pattern generator. The areas of the designs 42 indicating high pick and low pick count are formed as hereinbefore described.

As an example of operation of the above system on a pongee woven fabric to provide a checkerboard pattern, the odd numbered feet 44 in each set are programmed to operate for nine cycles, each cycle consisting of four picks activated (feet down to stretch and deviate the warp) followed by sixteen picks not activated (feet up away from the warp). This results in a group of nine designs 42 each about two inches in length and spaced widthwise across the fabric from the next adjacent group center to center about four inches. Then the even numbered feet in each set are operated for nine cycles in the same manner to provide the checkerboard pattern.

Each design, provided by the feet 44 above, is within the range of 1½"to 3"long and "1/16 to ⅛"in depth in the lengthwise direction of the fabric. Also, to prevent a long open line in the fabric as the designs 42 are being produced, the program is so set that adjacent odd or even numbered feet are actuated 10 picks apart so that feet 1, 5, 9, etc. are actuated together while feet 3, 7, 11, etc. are delayed 10 picks. This is also true of even feet 2, 6, 10, etc. and 4, 8, 12, etc.

The above operation is merely illustrative since the controller 40 can be programmed to provide many different arrangements of the designs merely by providing a different program to activate the air valves and consequently the action of the feet 44 in a different sequence.

Figure 5:
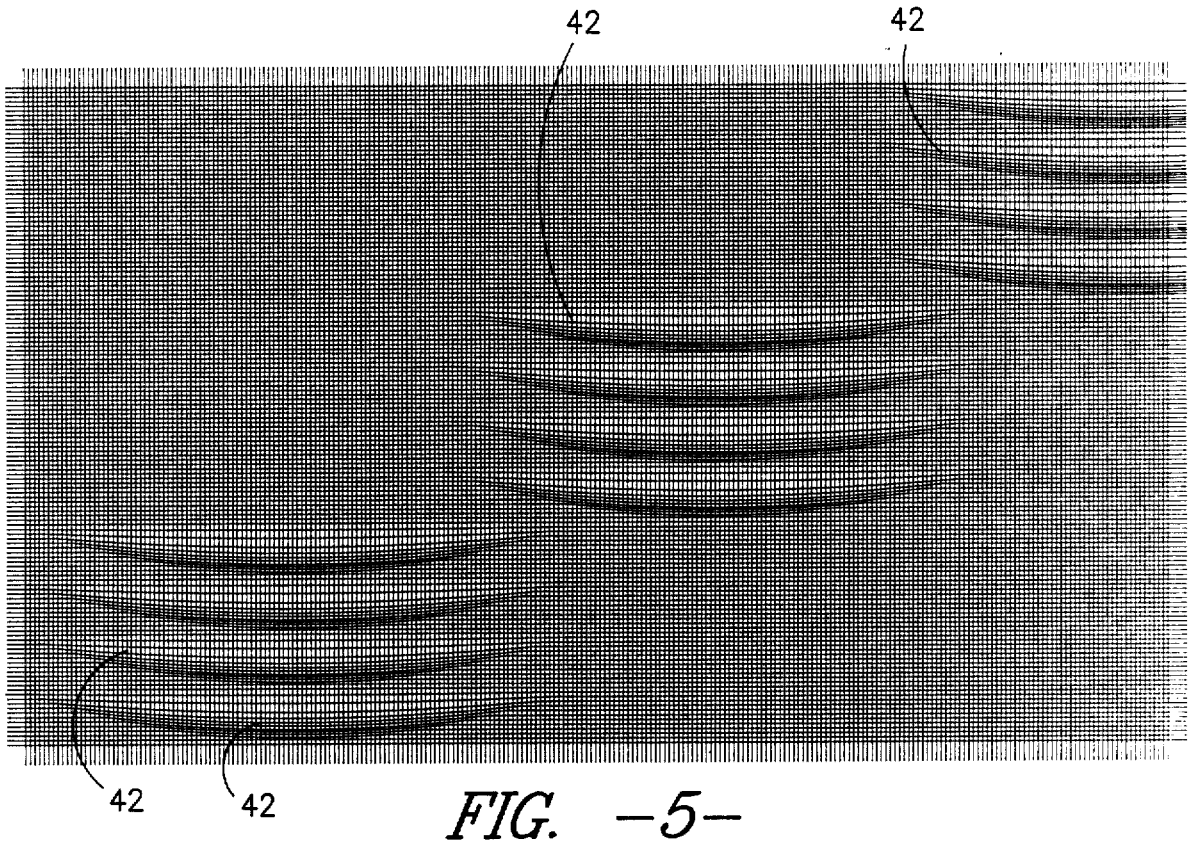
Figure 6:
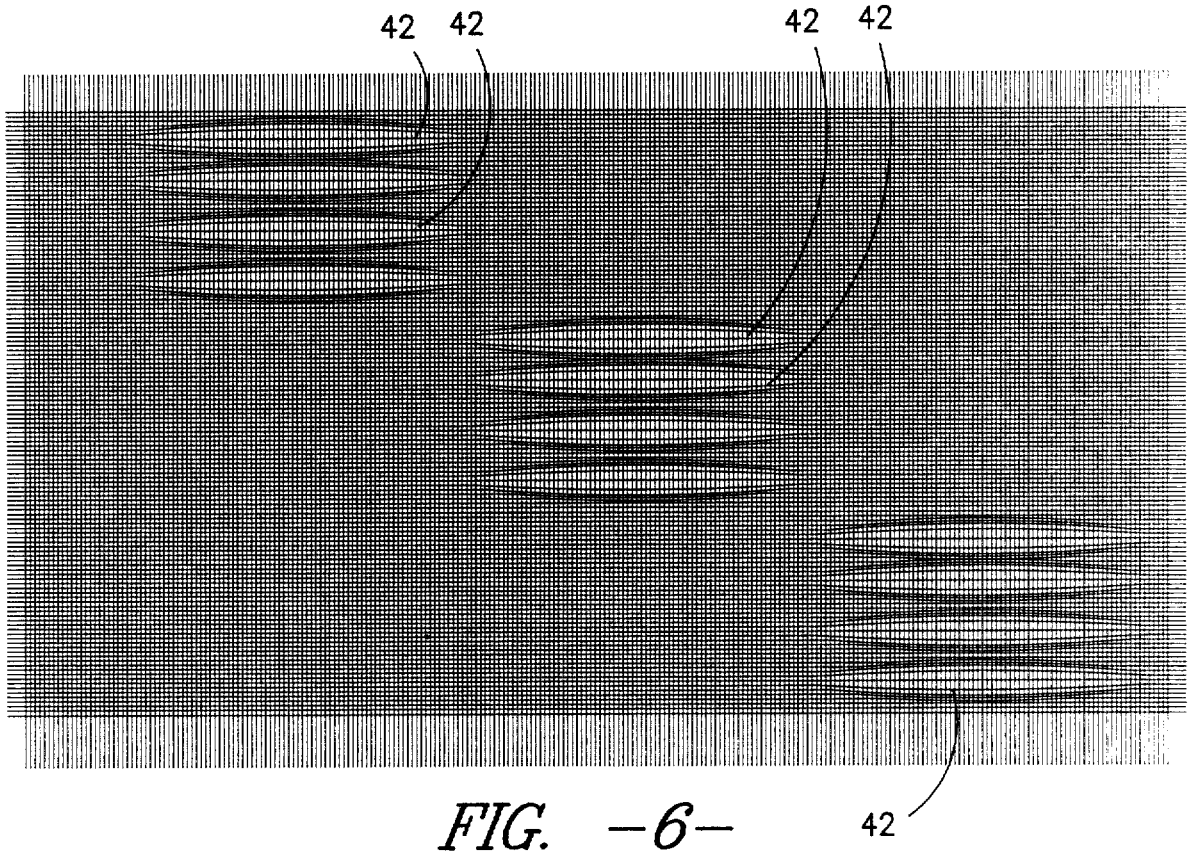
Figure 7:
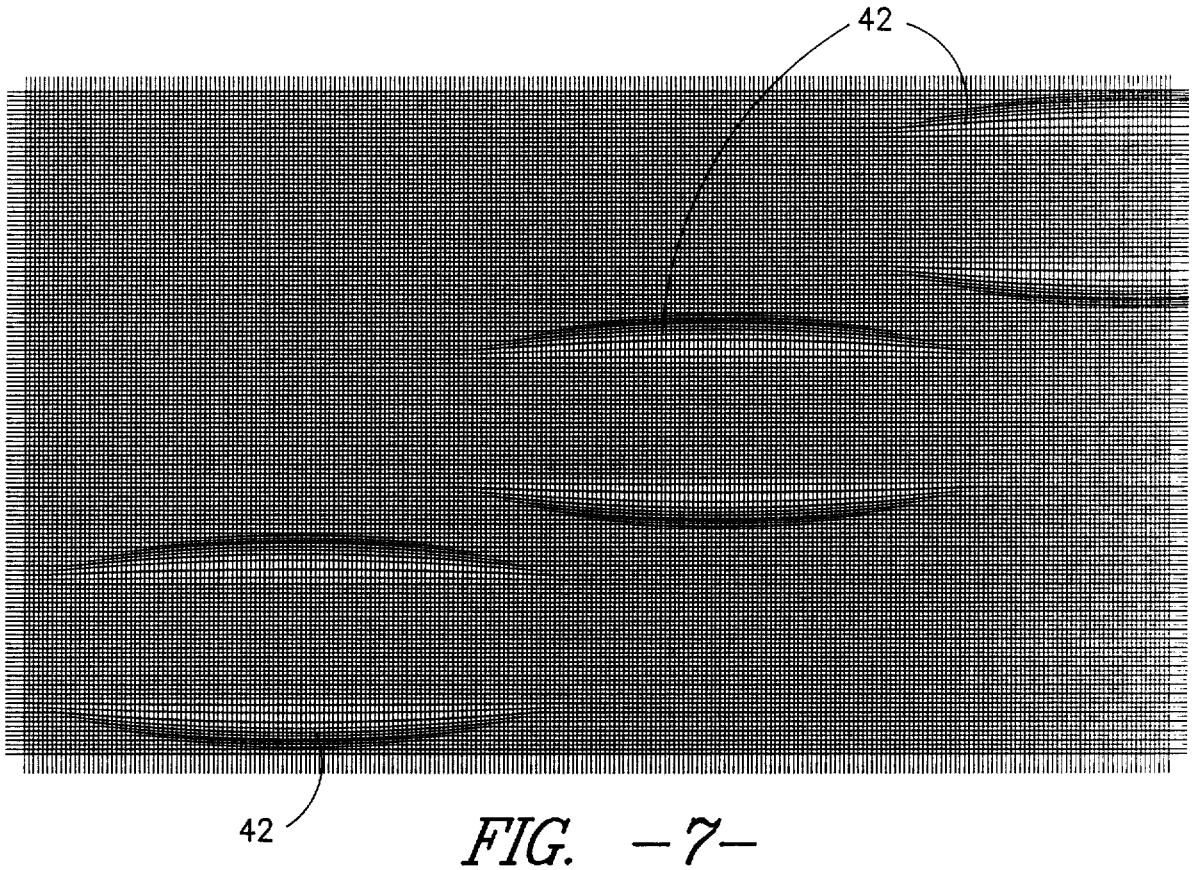

FIGS. 5–7 illustrate variations of the basic concept to provide alternate design locations and/or patterns. The designs 42 of the fabric in FIG. 4 were made by activating the foot 44 for only a few picks (i.e., about 2–6) followed by deactivation for some larger number of picks (i.e., about 8–20 minimum).

FIG. 5 illustrates the results of the reverse action of that to form the fabric of FIG. 4. Note that the high pick count area bows in the direction opposite to that in FIG. 4. This occurs because the short deactivation period does not allow enough time for the relaxed warp yarn to bow the straight picks inserted after the activation of the feet 44.

FIG. 6 illustrates a fabric with designs therein which are a composite of that shown in FIGS. 4 and 5. This fabric is produced by the activation and deactivation of the foot 44 for a small and similar number of picks (i.e., about 2–6). As can be seen, pairs of designs comprise diametrically bowed high pick count areas separated by a shared low pick count area.

The fabric of FIG. 7 is like that of FIG. 6 except that the foot 44 is activated/deactivated for a large number of picks so that the diametrically bowed areas of the design are spaced from one another by an area of normal pick count.

It can be seen that the above described system provides a method in which a woven fabric can be automatically patterned with a number of different patterns while still in the loom. The provision of the pattern device operating between the fell line and the take-up provides an opportunity for the operator to visually inspect the fabric as it is being patterned and to take immediate corrective steps if the fabric being produced does not have the desired pattern. Furthermore, the pattern generating equipment is readily available for change and repair if necessary.

Although the preferred embodiment of the invention has been described, it is contemplated that changes may be made within the scope or spirit of the invention and it is, therefore, desired that the invention be limited only by the scope of the claims.

We claim:

1. A patterned woven fabric comprising: a plurality of warp yarns interwoven with a plurality of fill yarns and a plurality of designs spaced longitudinally and transversely from one another in said fabric, each design having an area with a pick count lower than the average pick count of the fabric and an area of pick count higher than the average pick count of the fabric, said area of high pick count being located adjacent to the area of low pick count, said fill yarns in the areas of high pick count being arcuate shaped.

* * * * *